US006468031B1

(12) United States Patent
Yu et al.

(10) Patent No.: US 6,468,031 B1
(45) Date of Patent: Oct. 22, 2002

(54) NOZZLE CAVITY IMPINGEMENT/AREA REDUCTION INSERT

(75) Inventors: Yufeng Phillip Yu; Gary Michael Itzel, both of Simpsonville, SC (US); Sarah Jane Osgood, East Thetford, VT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/571,835

(22) Filed: May 16, 2000

(51) Int. Cl.[7] ..... F01D 9/06

(52) U.S. Cl. ..... 415/115; 415/114; 415/116; 416/96 A

(58) Field of Search ..... 415/114, 115, 415/116; 416/96 R, 96 A, 97 R

(56) References Cited

U.S. PATENT DOCUMENTS

| | | | | |
|---|---|---|---|---|
| 4,168,938 A | * | 9/1979 | Dodd | 416/97 R |
| 4,461,612 A | * | 7/1984 | Dodd | 416/96 A |
| 4,645,415 A | * | 2/1987 | Hovan et al. | 415/115 |
| 5,253,976 A | | 10/1993 | Cunha | |
| 5,399,065 A | * | 3/1995 | Kudo et al. | 415/115 |
| 5,536,143 A | | 7/1996 | Jacala | |
| 5,593,274 A | | 1/1997 | Carreno et al. | |
| 5,611,662 A | | 3/1997 | Cunha | |
| 5,634,766 A | | 6/1997 | Cunha et al. | |
| 5,685,693 A | | 11/1997 | Sexton et al. | |
| 5,743,708 A | | 4/1998 | Cunha et al. | |
| 6,183,192 B1 | | 2/2001 | Tressler et al. | |

FOREIGN PATENT DOCUMENTS

GB 1467483 A * 3/1977 ..... 416/96 A

OTHER PUBLICATIONS

"39$^{th}$ GE Turbine State–of–the–Art Technology Seminar", Tab 1, "F" Technology –the First Half–Million Operating Hours, H.E. Miller, Aug. 1996.

"39th GE Turbine State–of–the–Art Technology Seminar", Tab 2, "GE Heavy–Duty Gas Turbine Performance Characteristics", F. J. Brooks, Aug. 1996.

"39th GE Turbine State–of–the–Art Technology Seminar", Tab 3, "9EC 50Hz 170–MW Class Gas Turbine", A. S. Arrao, Aug. 1996.

"39th GE Turbine State–of–the–Art Technology Seminar", Tab 4, "MWS6001FA –An Advanced–Technology 70–MW Class 50/60 Hz Gas Turbine", Ramachandran et al., Aug. 1996.

(List continued on next page.)

*Primary Examiner*—Christopher Verdier
(74) *Attorney, Agent, or Firm*—Nixon & Vanderhye PC

(57) ABSTRACT

A turbine vane segment is provided that has inner and outer walls spaced from one another, a vane extending between the inner and outer walls and having leading and trailing edges and pressure and suction sides, the vane including discrete leading edge, intermediate, aft and trailing edge cavities between the leading and trailing edges and extending lengthwise of the vane for flowing a cooling medium; and an insert sleeve within at least one of the cavities and spaced from interior wall surfaces thereof. The insert sleeve has an inlet for flowing the cooling medium into the insert sleeve and has impingement holes defined in first and second walls thereof that respectively face the pressure and suction sides of the vane. The impingement holes of at least one of those first and second walls are defined along substantially only a first, upstream portion thereof, whereby the cooling flow is predominantly impingement cooling along a first region of the insert wall corresponding to the first, upstream portion and the cooling flow is predominantly convective cooling along a second region corresponding to a second, downstream portion of the at least one wall of the insert sleeve.

20 Claims, 4 Drawing Sheets

OTHER PUBLICATIONS

"39th GE Turbine State–of–the–Art Technology Seminar", Tab 5, "Turbomachinery Technology Advances at Nuovo Pignone", Benvenuti et al., Aug. 1996.
"39th GE Turbine State–of–the–Art Technology Seminar", Tab 6, "GE Aeroderivative Gas Turbines –Design and Operating Features", M.W. Horner, Aug. 1996.
"39th GE Turbine State–of–the–Art Technology Seminar", Tab 7, "Advance Gas Turbine Materials and Coatings", P.W. Schilke, Aug. 1996.
"39th GE Turbine State–of–the–Art Technology Seminar", Tab 8, "Dry Low $NO_x$ Combustion Systems for GE Heavy–Duty Turbines", L. B. Davis, Aug. 1996.
"39th GE Turbine State–of–the–Art Technology Seminar", Tab 9, "GE Gas Turbine Combustion Flexibility", M. A. Davi, Aug. 1996.
"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines, "J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program –Conceptual Design and Product Development", Annual Report, Sep. 1, 1994 –Aug. 31, 1995.
"Advanced Turbine Systems (ATS Program) Conceptual Design and Product Development", Final Technical Progress Report, vol. 2–Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993 –Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.

"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Numbers DE–FC21–95MC31176—11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.
"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.
"Gas, Steam Turbine Work as Single Unit in GE's Advanced H Technology Combined–Cycle Sytem", Press Information, Press Release, 95–NR18, May 16, 1995, Advanced Technology Introduction/pp. 1–3.
"GE Breaks 60% Net Efficiency Barrier" paper, 4 pages.
"GE Businesses Share Technologies and Experts to Develop State–Of–The–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D.C., Publication Release.
"H Technology commercialization", 1998 MarComm Activity Recommendation, Mar., 1998.
"H Technology", Jon Ebacher, VP, Power Gen Technology, May 8, 1998.
"H Testing Process", Jon Ebacher, VP, Power Gen Technology, May 8, 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency For GE "H" Technology Combined–Cycle Systems", Press Information, Press Release, 95–NRR16, May 16, 1995, H Technology/pp. 1–3.
"Overview of GE's H Gas Turbine Combined Cycle", Jul. 1, 1995 to Dec. 31, 1997.
"Power Systems for the 21st Century –"H" Gas Turbine Combined Cycles", Thomas C. Paul et al., Report,.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D.W. Esbeck, pp. 3–13, Oct., 1995.
"Proceedings of the Advanced Turbine Systems Annual Program Review Meeting", vol. I, "H Gas Turbine Combined Cycle", J. Corman, pp. 14–21, Oct., 1995.
"Proceedings of the Advanced Turbine Systems Annual Program Review Meeting", vol. I, "Overview of Westinghouse's Advanced Turbine Systems Program", Bannister et al., pp. 22–30, Oct., 1995.
"Proceedings of the Advanced Turbine Systems Annual Program Review Meeting", vol. I, "Allison Engine ATS Program Technical Review", D. Mukavetz pp. 31–42, Oct., 1995.
"Proceedings of the Advanced Turbine Systems Annual Program Review Meeting", vol. I, "Advanced Turbine Systems Program Industrial System Concept Development", S. Gates, pp. 43–63, Oct., 1995.
"Proceedings of the Advanced Turbine Systems Annual Program Review Meeting", vol. I, "Advanced Turbine System Program Phase 2 Cycle Selection", Latcovich, Jr., pp. 64–69, Oct., 1995.
"Proceedings of the Advanced Turbine Systems Annual Program Review Meeting", vol. I, "General Electric ATS Program Technical Review Phase 2 Activities", Chance et al., pp. 70–74, Oct., 1995.
"Proceedings of the Advanced Turbine Systems Annual Program Review Meeting", vol. I, "Technical Review of Westinghouse's Advanced Turbine Systems Program", Diakunchak et al., pp. 75–86, Oct., 1995.
"Proceedings of the Advanced Turbine Systems Annual Program Review Meeting", vol. I, "Advanced Combustion Turbines and Cycles: An EPRI Perspective", Touchton et al., pp. 87–88, Oct., 1995.
"Proceedings of the Advanced Turbine Systems Annual Program Review Meeting", vol. I, "Advanced Turbine Systems Annual Program Review", William E. Koop, pp. 89–92, Oct., 1995.
"Proceedings of the Advanced Turbine Systems Annual Program Review Meeting", vol. I, "The AGTSR Consortium: An Update", Fant et al., pp. 93–102, Oct., 1995.
"Proceedings of the Advanced Turbine Systems Annual Program Review Meeting", vol. I, "Overview of Allison/AGTSR Interactions", Sy A. Ali, pp. 103–106, Oct., 1995.
"Proceedings of the Advanced Turbine Systems Annual Program Review Meeting", vol. I, "Design Factors for Stable Lean Premix Combustion", Richards et al., pp. 107–113, Oct., 1995.
"Proceedings of the Advanced Turbine Systems Annual Program Review Meeting", vol. I, "Ceramic Stationary as Turbine", M. van Roode, pp. 114–147, Oct., 1995.
"Proceedings of the Advanced Turbine Systems Annual Program Review Meeting", vol. I, "DOE/Allison Ceramic Vane Effort", Wenglarz et al., pp. 148–151, Oct., 1995.
"Proceedings of the Advanced Turbine Systems Annual Program Review Meeting", vol. I, "Materials/Manufacturing Element of the Advanced Turbine Systems Program", Karnitz et al., pp. 152–160, Oct., 1995.
"Proceedings of the Advanced Turbine Systems Annual Program Review Meeting", vol. I, "Land–Based Turbine Casting Initiative", Mueller et al., pp. 161–170, Oct., 1995.
"Proceedings of the Advanced Turbine Systems Annual Program Review Meeting", vol. I, "Turbine Airfoil Manufacturing Technology", Kortovich, pp. 171–181, Oct., 1995.

"Proceedings of the Advanced Turbine Systems Annual Program Review Meeting", vol. I, "Pratt & Whitney Thermal Barrier Coatings", Bornstein et al., pp. 182–193, Oct., 1995.

"Proceedings of the Advanced Turbine Systems Annual Program Review Meeting", vol. I, "Westinhouse Thermal Barrier Coatings", Goedjen et al., pp. 194–199, Oct., 1995.

"Proceedings of the Advanced Turbine Systems Annual Program Review Meeting", vol. I, "High Performance Steam Development", Duffy et al., pp. 200–220, Oct., 1995.

"Proceedings of the Advanced Turbine Systems Annual Program Review Meeting", vol. II, "Lean Premixed Combustion Stabilized by Radiation Feedback and heterogeneous Catalysis", Dibble et al., pp. 221–232, Oct., 1995.

"Proceedings of the Advanced Turbine Systems Annual Program Review Meeting", vol. II, Rayleigh/Raman/LIF Measurements in a Turbulent Lean Premixed Combustor, Nandula et al. pp. 233–248, Oct., 1995.

"Proceedings of the Advanced Turbine Systems Annual Program Review Meeting", vol. II, "Lean Premixed Flames for Low $No_x$ Combustors", Sojka et al., pp. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., pp. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., pp. 281–309, Oct., 1995.

"Proceedings of the Advanced Turbine Systems Annual Program Review Meeting", vol. II, "Life Prediction of Advanced Materials for Gas Turbine Application", Zamrik et al., pp. 310–327, Oct., 1995.

"Proceedings of the Advanced Turbine Systems Annual Program Review Meeting", vol. II, "Advanced Combustion Technologies for Gas Turbine Power Plants", Vandsburger et al., pp. 328–352, Oct., 1995.

"Proceedings of the Advanced Turbine Systems Annual Program Review Meeting", vol. II, "Combustion Modeling in Advanced Gas Turbine Systems", Smoot et al., pp. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. pp. 371–390, Oct., 1995.

"Proceedings of the Advanced Turbine Systems Annual Program Review Meeting", vol. II, "Rotational Effects on Turbine Blade Cooling", Govatzidakia et al., pp. 391–392, Oct., 1995.

"Proceedings of the Advanced Turbine Systems Annual Program Review Meeting", vol. II, "Manifold Methods for Methane Combustion", Yang et al., pp. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., pp. 410–414, Oct., 1995.

"Proceedings of the Advanced Turbine Systems Annual Program Review Meeting", vol. II, The Role of Reactant Unmixedness, Strain Rate, and Length Scale on Premixed Combustor Performance, Samuelson et al., pp. 415–422, Oct., 1995.

"Proceedings of the Advanced Turbine Systems Annual Program Review Meeting", vol. II, "Experimental and Computational Studies of Film Cooling With Compound Angle Injection", Goldstein et al., pp. 423–451, Oct., 1995.

"Proceedings of the Advanced Turbine Systems Annual Program Review Meeting", vol. II, "Compatibility of Gas Turbine Materials with Steam Cooling", Desai et al., pp. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, pp. 465–473, Oct., 1995.

"Proceedings of the Advanced Turbine Systems Annual Program Review Meeting", vol. II, Effects of Geometry on Slot–Jet Film Cooling Performance, Hyams et al., pp. 474–496 Oct., 1995.

"Proceedings of the Advanced Turbine Systems Annual Program Review Meeting", vol. II, "Steam as Turbine Blade Coolant: Experimental Data Generation", Wilmsen et al., pp. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., pp. 506–515, Oct., 1995.

"Proceedings of the Advanced Turbine Systems Annual Program Review Meeting", vol. II, "Premixed Burner Experiments: Geometry, Mixing, and Flame Structure Issues", Gupta et al., pp. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., pp. 529–538, Oct., 1995.

"Proceedings of the Advanced Turbine Systems Annual Program Review Meeting", vol. II, "Bond Strength and Stress Measurements in Thermal Barrier Coatings", Gell et al., pp. 539–549, Oct., 1995.

"Proceedings of the Advanced Turbine Systems Annual Program Review Meeting", vol. II, "Active Control of Combustion Instabilities in Low $NO_x$ GasTurbines", Zinn et al., pp. 550–551, Oct., 1995.

"Proceedings of the Advanced Turbine Systems Annual Program Review Meeting", vol. II, "Combustion Instability Modeling and Analysis", Santoro et al., pp. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., pp. 560–565, Oct., 1995.

"Proceedings of the Advanced Turbine Systems Annual Program Review Meeting", vol. II, "Heat Pipe Turbine Vane Cooling", Langston et al., pp. 566–572, Oct., 1995.

"Proceedings of the Advanced Turbine Systems Annual Program Review Meeting", vol. II, "Improved Modeling Techniques for Turbomachinery Flow Fields", Lakshminarayana et al., pp. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, pp. 3–16, Nov., 1996.

"Proceedings of the Advanced Turbine Systems Annual Program Review Meeting", "Power Needs in the Chemical Industry", Keith Davidson, pp. 17–26, Nov., 1996.

"Proceedings of the Advanced Turbine Systems Annual Program Review Meeting", "Advanced Turbine Systems Program Overview", David Esbeck, pp. 27–34, Nov., 1996.

"Proceedings of the Advanced Turbine Systems Annual Program Review Meeting", "Westinghouse's Advanced Turbine Systems Program", Gerard McQuiggan, pp. 35–48, Nov., 1996.

"Proceedings of the Advanced Turbine Systems Annual Program Review Meeting", "Overview of GE's H Gas Turbine Combined Cycle", Cook et al., pp. 49–72, Nov., 1996.

"Proceedings of the Advanced Turbine Systems Annual Program Review Meeting", "Allison Advanced Simple Cycle Gas Turbine System", William D. Weisbrod, pp. 73–94, Nov., 1996.

"Proceedings of the Advanced Turbine Systems Annual Program Review Meeting", "The AGTSR Industry–University Consortium", Lawrence P. Golan, pp. 95–110, Nov., 1996.

"Proceedings of the Advanced Turbine Systems Annual Program Review Meeting", "$NO_x$ and CO Emissions Models for Gas–Fired Lean–Premixed Combustion Turbines", A. Mellor pp. 111–122, Nov., 1996.

"Proceedings of the Advanced Turbine Systems Annual Program Review Meeting", "Methodologies for Active Mixing and Combustion Control", Uri Vandsburger, pp. 123–156, Nov., 1996.

"Proceedings of the Advanced Turbine Systems Annual Program Review Meeting", "Combustion Modeling in Advanced Gas Turbine Systems", Paul O. Hedman, pp. 157–180, Nov., 19967.

"Proceedings of the Advanced Turbine Systems Annual Program Review Meeting", "Manifold Methods for Methane Combustion", Stephen B. Pope, pp. 181–188, Nov., 1996.

"Proceedings of the Advanced Turbine Systems Annual Program Review Meeting", "The Role of Reactant Unmixedness, Strain Rate, and Length Scale on Premixed Combustor Performance", Scott Samuelsen, pp. 189–210, Nov., 1996.

"Proceedings of the Advanced Turbine Systems Annual Program Review Meeting", "Effect of Swirl and Momentum Distribution on Temperature Distribution in Premixed Flames", Ashwani K. Gupta, pp. 211–232, Nov., 1996.

"Proceedings of the Advanced Turbine Systems Annual Program Review Meeting", "Combustion Instability Studies Application to Land–Based Gas Turbine Combustors", Robert J. Santoro, pp. 233–252.

"Proceedings of the Advanced Turbine Systems Annual Program Review Meeting", Active Control of Combustion Instabilities in Low $NO_x$ Turbines, Ben T. Zinn, pp. 253–264, Nov., 1996.

"Proceedings of the Advanced Turbine Systems Annual Program Review Meeting", "Life Prediction of Advanced Materials for Gas Turbine Application," Sam Y. Zamrik, pp. 265–274, Nov., 1996.

"Proceedings of the Advanced Turbine Systems Annual Program Review Meeting", "Combustion Chemical Vapor Deposited Coatings for Thermal Barrier Coating Systems", W. Brent Carter, pp. 275–290, Nov., 1996.

"Proceedings of the Advanced Turbine Systems Annual Program Review Meeting", "Compatibility of Gas Turbine Materials with Steam Cooling", Vimal Desai, pp. 291–314, Nov., 1996.

"Proceedings of the Advanced Turbine Systems Annual Program Review Meeting", "Bond Strength and Stress Measurements in Thermal Barrier Coatings", Maurice Gell, pp. 315–334, Nov., 1996.

"Proceedings of the Advanced Turbine Systems Annual Program Review Meeting", "Advanced Multistage Turbine Blade Aerodynamics, Performance, Cooling and Heat Transfer", Sanford Fleeter, pp. 335–356, Nov., 1996.

"Proceedings of the Advanced Turbine Systems Annual Program Review Meeting", "Flow Characteristics of an Intercooler System for Power Generating Gas Turbines", Ajay K. Agrawal, pp. 357–370, Nov., 1996.

"Proceedings of the Advanced Turbine Systems Annual Program Review Meeting", "Improved Modeling Techniques for Turbomachinery Flow Fields", B. Lakshiminarayana, pp. 371–392, Nov., 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, pp. 393–406, Nov., 1996.

"Proceedings of the Advanced Turbine Systems Annual Program Review Meeting", "Advanced Turbine Cooling, Heat Transfer, and Aerodynamic Studies", Je–Chin Han, pp. 407–426, Nov., 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, pp. 427–446.

"Proceedings of the Advanced Turbine Systems Annual Program Review Meeting", "Experimental and Computational Studies of Film Cooling with Compound Angle Injection", R. Goldstein, pp. 447–460, Nov., 1996.

"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, pp. 461–470, Nov., 1996.

"Proceedings of the Advanced Turbine Systems Annual Program Review Meeting", "Steam as Turbine Blade Coolant: External Side Heat Transfer", Abraham Engeda, pp. 471–482, Nov., 1996.

"Proceedings of the Advanced Turbine Systems Annual Program Review Meeting", "Flow and Heat Transfer in Gas Turbine Disk Cavities Subject to Nonuniform External Pressure Field", Ramendra Roy, pp. 483–498, Nov., 1996.

"Proceedings of the Advanced Turbine Systems Annual Program Review Meeting", "Closed–Loop Mist/Steam Cooling for Advanced Turbine Systems", Ting Wang, pp. 499–512, Nov., 1996.

"Proceedings of the Advanced Turbine Systems Annual Program Review Meeting", "Heat Pipe Turbine Vane Cooling", Langston et al., pp. 513–534, Nov., 1996.

"Proceedings of the Advanced Turbine Systems Annual Program Review Meeting", "EPRI's Combustion Turbine Program: Status and Future Directions", Arthur Cohn, pp. 535,–552 Nov., 1996.
"Proceedings of the Advanced Turbine Systems Annual Program Review Meeting", "ATS Materials Support", Michael Karnitz, pp. 553–576, Nov., 1996.
"Proceedings of the Advanced Turbine Systems Annual Program Review Meeting", "Land Based Turbine Casting Initiative", Boyd A. Mueller, pp. 577–592, Nov., 1996.
"Proceedings of the Advanced Turbine Systems Annual Program Review Meeting", "Turbine Airfoil Manufacturing Technology", Charles S. Kortovich, pp. 593–622, Nov., 1996.
"Proceedings of the Advanced Turbine Systems Annual Program Review Meeting", "Hot Corrosion Testing of TBS's", Norman Bornstein, pp. 623–631, Nov., 1996.
"Proceedings of the Advanced Turbine Systems Annual Program Review Meeting", "Ceramic Stationary Gas Turbine", Mark van Roode, pp. 633–658, Nov., 1996.
"Proceedings of the Advanced Turbine Systems Annual Program Review Meeting", "Western European Status of Ceramics for Gas Turbines", Tibor Bornemisza, pp. 659–670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's H Gas Turbine –High Efficiency, Low Cost of Electricity and Low Emissions", Roger Schonewald and Patrick Marolda, (no date available),.
"Testing Program Results Validate GE's H Gas Turbine –High Efficiency, Low Cost of Electricity and Low Emissions", Slide Presentation –working draft, (no date available).
"The Next Step in H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1, 1997, Report Numbers: DOE/MC/31176—5628,.
"Utility Advanced Turbine System (ATS) Technology Readiness Testing —Phase 3", Document #666274, Oct. 1, 1996–Sep. 30, 1997, Publication Date, Dec. 31, 1997, Report Numbers: DOE/MC/31176—10.
"Utility Advanced Turbine System (ATS) Technology Readiness Testing and Pre–Commercial Demonstration, Phase 3", Document #486029, Oct. 1 –Dec. 31, 1995, Publication Date, May 1, 1997, Report Numbers: DOE/MC/31176—5340.
"Utility Advanced Turbine System (ATS) Technology Readiness Testing and Pre–Commercial Demonstration –Phase 3", Document #486132, Apr. 1 –Jun. 30, 1976, Publication Date, Dec. 31, 1996, Report Numbers: DOE/MC/31176—5660.
"Utility Advanced Turbine System (ATS) Technology Readiness Testing and Pre–Commercial Demonstration —Phase 3", Document #587906, Jul. 1 –Sep. 30, 1995, Publication Date, Dec. 31, 1995, Report Numbers: DOE/MC/31176—5339.
"Utility Advanced Turbine System (ATS) Technology Readiness Testing and Pre–Commercial Demonstration" Document #666277, Apr. 1 –Jun. 30, 1997, Publication Date, Dec. 31, 1997, Report Numbers: DOE/MC/31176—8.
"Utility Advanced Turbine System (ATS) Technology Readiness Testing and Pre–Commercialization Demonstration" Jan. 1 –Mar. 31, 1996, DOE/MC/31176—5338.
"Utility Advanced Turbine System (ATS) Technology Readiness Testing: Phase 3R", Document #756552, Apr. 1 –Jun. 30, 1999, Publication Date, Sep. 1, 1999, Report Numbers: DE—FC21–95MC31176–23.
"Utility Advanced Turbine System (ATS) Technology Readiness Testing.", Document #656823, Jan. 1 –Mar. 31, 1998, Publication Date, Aug. 1, 1998, Report Numbers: DOE/MC/31176–17.
"Utility Advanced Turbine Systems (ATS) Technology Readiness Testing and Pre–Commercial Demonstration", Annual Technical Progress Report, Reporting Period: Jul. 1, 1995 –Sep. 30, 1996.
"Utility Advanced Turbine Systems (ATS) Technology Readiness Testing", Phase 3R, Annual Technical Progress Report, Reporting Period: Oct. 1, 1997 –Sep. 30, 1998.
"Utility Advanced Turbine Systems (ATS) Technology Readiness Testing and Pre–Commercial Demonstration", Annual Technical Progress Report, Reporting Period: Jul. 1, 1995 –Sep. 30, 1996.
"Utility Advanced Turbine Systems (ATS) Technology Readiness Testing", Document #750405, Oct. 1 –Dec. 30, 1998, Publication Date: May, 1, 1999, Report Numbers: DE–FC21–95MC31176–20.
"Utility Advanced Turbine Systems (ATS) Technology Readiness Testing", Document #1348, Apr. 1 –Jun. 29, 1998, Publication Date Oct. 29, 1998, Report Numbers DE–FC21–95MC31176—18.
"Utility Advanced Turbine Systems (ATS) Technology Readiness Testing –Phase 3", Annual Technical Progress Report, Reporting Period: Oct. 1, 1996 –Sep. 30, 1997.
"Utility Advanced Turbine Systems (ATS) Technology Readiness Testing and Pre–Commercial Demonstration", Quarterly Report, Jan. 1 –Mar. 31, 1997, Document #666275, Report Numbers: DOE/MC/31176–07.
"Proceedings of the 1997 Advanced Turbine Systems", Annual Program Review Meeting, Oct. 28–29, 1997.

* cited by examiner

NOZZLE CAVITY IMPINGEMENT/AREA REDUCTION INSERT

This invention was made with Government support under Government contract No. DE-FC21-95-MC31176 awarded by the Department of Energy. The Government has certain rights in this invention.

BACKGROUND OF THE INVENTION

The present invention relates generally to gas turbines, for example, for electrical power generation, and more particularly to cooling the stage one nozzles of such turbines. The invention relates in particular to an insert design for a gas turbine nozzle cavity that provides for both convection and impingement cooling.

The traditional approach for cooling turbine blades and nozzles was to extract high pressure cooling air from a source, for example, from the intermediate and final stages of the turbine compressor. In such a system, a series of internal flow passages are typically used to achieve the desired mass flow objectives for cooling the turbine blades. In contrast, external piping is used to supply air to the nozzles, with air film cooling typically being used and the air exiting into the hot gas stream of the turbine. In advanced gas turbine designs, it has been recognized that the temperature of the hot gas flowing past the turbine components could be higher than the melting temperature of the metal. It was therefore necessary to establish a cooling scheme to protect the hot gas path components during operation. Steam has been demonstrated to be a preferred cooling media for cooling gas turbine nozzles (stator vanes), particularly for combined-cycle plants. See, for example, U.S. Pat. No. 5,253,976, the disclosure of which is incorporated herein by this reference. For a complete description of the steam-cooled buckets, reference is made to U.S. Pat. No. 5,536,143, the disclosure of which is incorporated herein by reference. For a complete description of the steam (or air) cooling circuit for supplying cooling medium to the first and second stage buckets through the rotor, reference is made to U.S. Pat. No. 5,593,274, the disclosure of which is incorporated herein by reference.

Because steam has a higher heat capacity than the combustion gas, however, it is inefficient to allow the coolant steam to mix with the hot gas stream. Consequently, in conventional steam cooled buckets it has been considered desirable to maintain cooling steam inside the hot gas path components in a closed circuit. Nevertheless, certain areas of the components in the hot gas path cannot practically be cooled with steam in a closed circuit. For example, the relatively thin structure of the trailing edge of the nozzle vane effectively precludes steam cooling of that edge. Accordingly, air cooling is used to cool those portions of the nozzle vanes. For a complete description of the steam cooled nozzles with air cooling along the trailing edge, reference is made to U.S. Pat. No. 5,634,766, the disclosure of which is incorporated herein by reference. The flow of cooling air in a trailing edge cavity per se is the subject of a U.S. Pat. No. 5,611,662, the disclosure of which is incorporated herein by reference.

In the closed circuit system, a plurality of nozzle vane segments are provided, each of which comprises one or more nozzle vanes extending between inner and outer side walls. The vanes have a plurality of cavities in communication with compartments in the outer and inner side walls for flowing cooling media in a closed circuit for cooling the outer and inner walls and the vanes per se. Thus, cooling media may be provided to a plenum in the outer wall of the segment for distribution to chambers therein and passage through impingement openings in a plate for impingement cooling of the outer wall surface of the segment. The spent impingement cooling media flows into leading edge and aft cavities extending radially through the vane. At least one cooling fluid return/intermediate cooling cavity extends radially and lies between the leading edge and aft cavities. A separate trailing edge cavity may also provided.

Conventionally, in each of the leading edge, intermediate and aft cavities, inserts are provided, having impingement flow holes. Thus, impingement cooling is typically provided in the leading and aft cavities of the vane, as well as in the return cavities of the first stage nozzle vane. The inserts in the leading and aft cavities comprise sleeves having a collar at their inlet ends for connection with integrally cast flanges in the outer wall and extend through the cavities spaced from the walls thereof. The inserts have impingement holes in opposition to the walls of the cavity whereby steam or air flowing into the inserts flows outwardly through the impingement holes for impingement cooling of the vane walls. Similarly, inserts in the return intermediate cavities have impingement openings for flowing impingement cooling medium against the side walls of the vane.

BRIEF SUMMARY OF THE INVENTION

A problem encountered in conventional closed circuit cooled turbine nozzles, whether air or steam is used as the coolant, is that the post impingement coolant can become cross flow and reduce the effectiveness of more downstream impingement cooling. This also causes uncertainty in the calculations used to determine the cross flow effect upon heat transfer coefficient along the cavity.

Another problem encountered in conventional nozzle cavity impingement cooling systems is that due to the significant post impingement cross flow in a small cavity, a large pressure drop is needed to achieve adequate heat transfer coefficients. This large pressure drop results in a more complex design of other parts of the nozzle cooling circuit, to balance the pressure drop from other branches of the closed circuit. In most cases, excessive pressure drop from the cooling flow may not be possible due to other restrictions in the design. Reducing this pressure drop would allow for more simplified designs elsewhere in the flow circuit. It may also be required for the system to operate efficiently.

One way in which this cross flow problem has been partially addressed is to define ribs oriented generally transverse to the radial extent of the nozzle cavities so that post impingement coolant flows in a chord-wise direction to a post impingement cooling flow channel for passage to the radially inner wall of the vane segment. However, it would be desirable to address the foregoing problems associated with current nozzle insert design in a manner that would simplify the design of the vane cavity and the insert, reduce or eliminate the cross flow effect and reduce the uncertainty associated with the design.

The inventors have recognized that reducing the amount of impingement, or changing it from impingement cooling to convective cooling, will reduce or eliminate the cross flow effect and reduce the uncertainty associated with the design. More specifically, the present invention provides a novel cavity insert design wherein the amount of impingement flow is reduced so that the cooling provided along a portion of the length of the nozzle cavity is changed from impingement cooling to convective cooling. This reduces or eliminates the cross-flow effect and reduces the uncertainty associated with the design.

Accordingly, in an embodiment of the present invention, there is provided a closed circuit stator vane segment comprising radially inner and outer walls spaced from one another, a vane extending between the inner and outer walls and having leading and trailing edges and pressure and suction sides, the vane including discrete cavities between the leading and trailing edges and extending lengthwise of the vane, and an insert sleeve in at least one of those cavities, the insert sleeve having impingement holes for directing the cooling media against interior wall surfaces of the cavity. The impingement holes are defined in first and second walls of the insert sleeve facing respectively the pressure and suction sides of the vane. However, the impingement holes of at least one of those first and second walls are defined along substantially only a first, upstream portion thereof whereby the cooling flow is predominantly impingement cooling along the first, upstream portion and the cooling flow is predominantly convective cooling along a second, downstream portion thereof.

In a currently preferred embodiment, the impingement holes of both the first and second walls of the insert sleeve extend along substantially only respective first, upstream portions thereof so that there is a transition to convective cooling along both those walls. Even more preferably, the impingement holes in the second wall, facing the suction side of the vane extend along a lesser extent of that wall than the impingement holes in the first wall.

BRIEF DESCRIPTION OF THE DRAWINGS

These, as well as other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
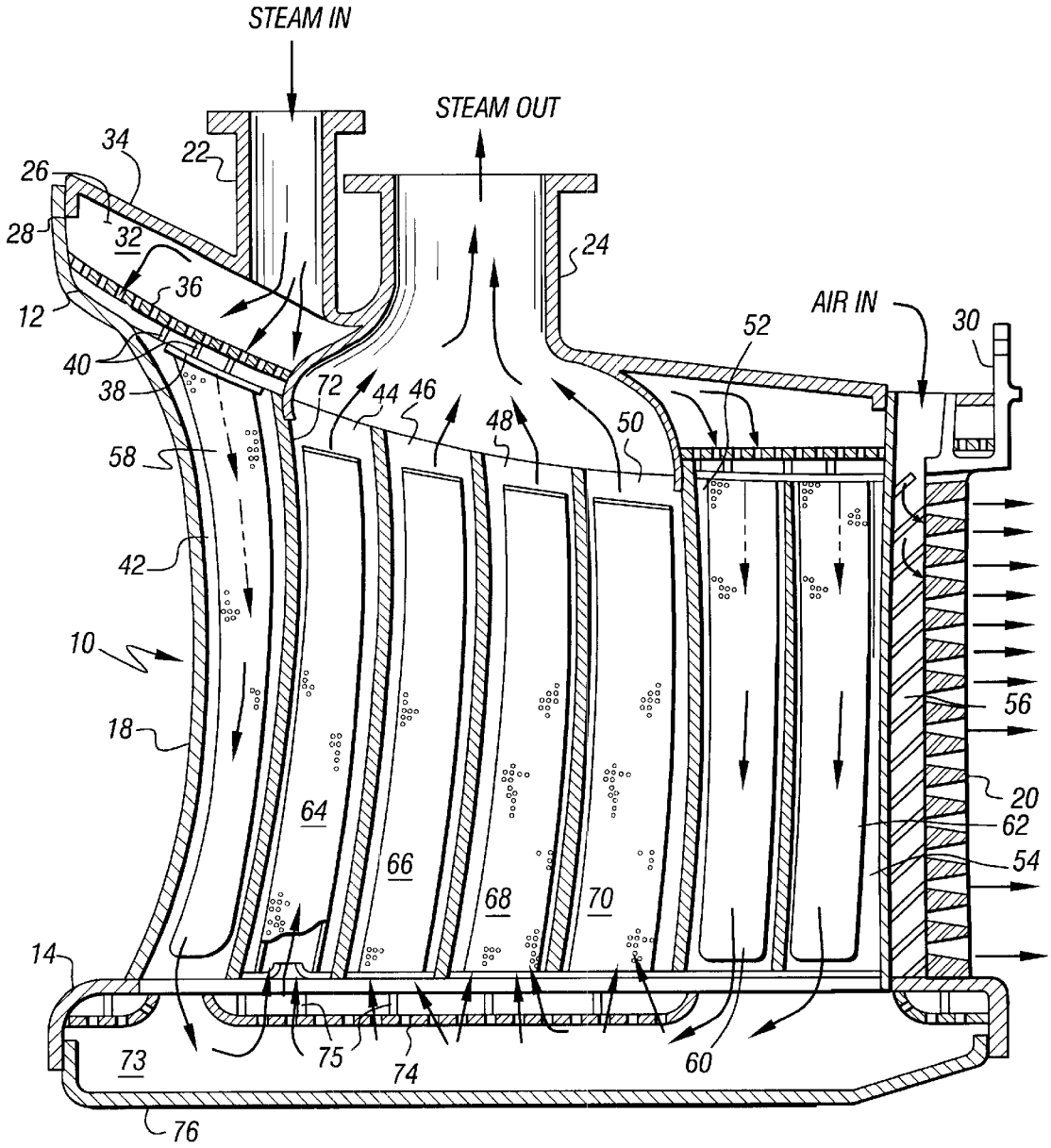
FIG. 1 is a schematic, cross-sectional view of an exemplary first stage nozzle vane embodying the invention.

As discussed previously, the present invention relates in particular to cooling circuits for the first stage nozzles of a turbine, reference being made to the previously identified patents for disclosures of various other aspects of the turbine, its construction and methods of operation. Referring now to FIG. 1, there is schematically illustrated in cross-section a vane 10 comprising one of the plurality of circumferentially arranged segments of the first stage nozzle. It will be appreciated that the segments are connected one to the other to form an annular array of segments defining the hot gas path through the first stage nozzle of the turbine. Each segment includes radially spaced outer and inner walls 12 and 14, respectively, with one or more of the nozzle vanes 10 extending between the outer and inner walls. The segments are supported about the inner shell of the turbine (not shown) with adjoining segments being sealed one to the other. It will therefore be appreciated that the outer and inner walls and the vanes extending therebetween are wholly supported by the inner shell of the turbine and are removable with the inner shell halves of the turbine upon removal of the outer shell as set forth in U.S. Pat. No. 5,685,693. For purposes of this description, the vane 10 will be described as forming the sole vane of a segment.

As shown in the schematic illustration of FIG. 1, the vane has a leading edge 18, a trailing edge 20, and a cooling steam inlet 22 to the outer wall 12. A return steam outlet 24 also lies in communication with the nozzle segment. The outer wall 12 includes outer side railings 26, a leading railing 28, and a trailing railing 30 defining a plenum 32 with the upper wall surface 34 and an impingement plate 36 disposed in the outer wall 12. (The terms outwardly and inwardly or outer and inner refer to a generally radial direction). Disposed between the impingement plate 36 and the inner wall 38 of outer wall 12 are a plurality of structural ribs 40 extending between the side railings 26, leading railings 28 and trailing railing 30. The impingement plate 36 overlies the ribs 40 throughout the full extent of the plenum 32. Consequently, steam entering through inlet port 22 into plenum 32 passes through the openings in the impingement plate 36 for impingement cooling of the inner surface 38 of the outer wall 12.

In this exemplary embodiment, the first stage nozzle vane 10 has a plurality of cavities, for example, a leading edge cavity 42, two aft cavities 52, 54, four intermediate return cavities 44, 46, 48 and 50, and also a trailing edge cavity 56.

Figure 2:
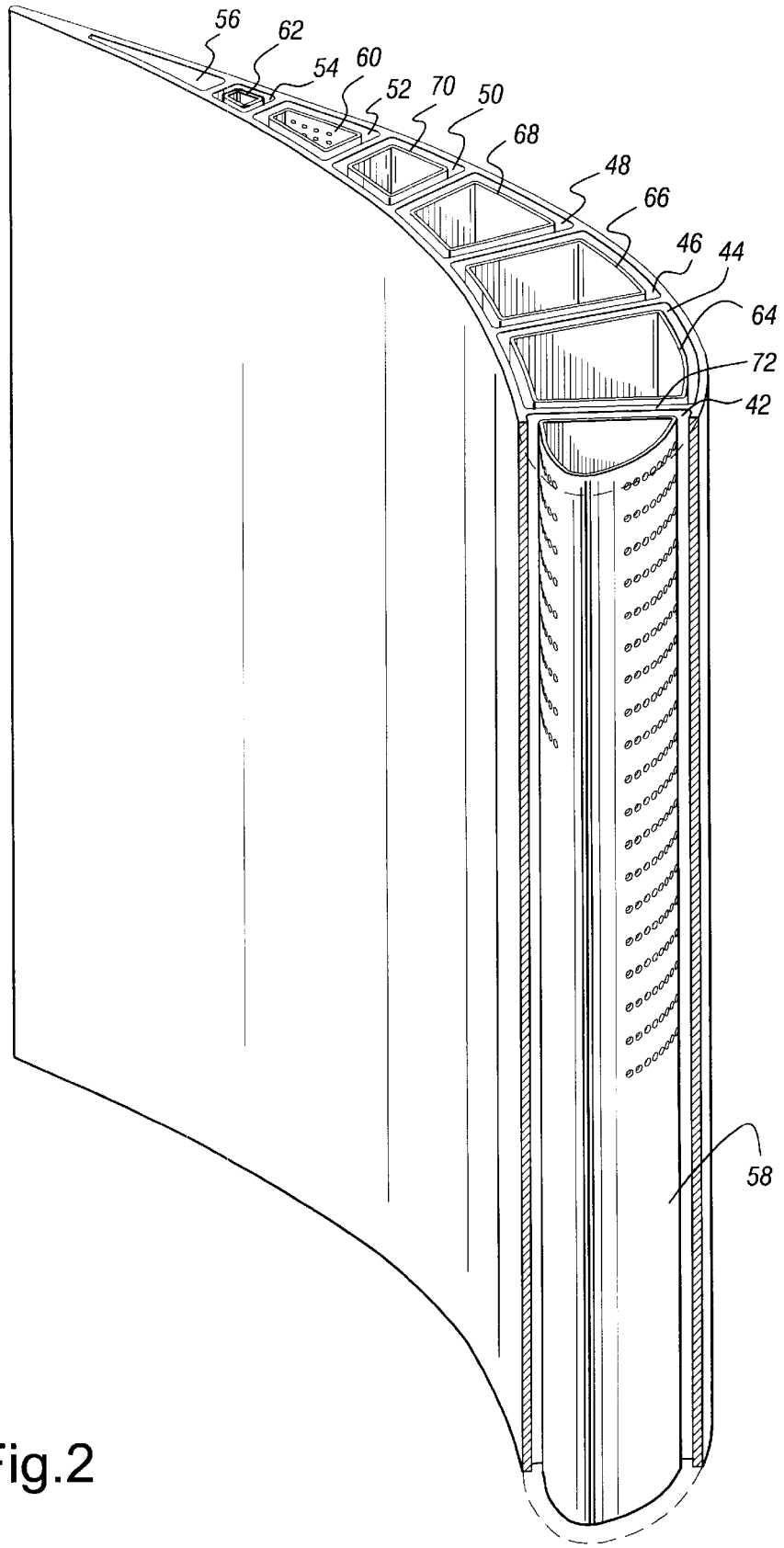
FIG. 2 is a schematic, broken away perspective view of a first stage nozzle vane with an impingement cooling insert sleeve embodying the invention disposed in a vane cavity thereof.

Leading edge cavity 42 and aft cavities 52, 54 each have an insert sleeve, 58, 60, and 62, respectively, while each of the intermediate cavities 44, 46, 48 and 50 have similar insert sleeves 64, 66, 68, and 70, respectively, all such insert sleeves being in the general form of hollow sleeves, having perforations as described in greater detail herein below. The insert sleeves are preferably shaped to correspond to the shape of the particular cavity in which the insert sleeve is to be provided and sides of the sleeves are provided with a plurality of impingement cooling openings, along portions of the insert sleeve which lie in opposition to the walls of the cavity to be impingement cooled. For example, as shown in FIG. 2, in the leading edge cavity 42, the forward edge of the insert sleeve 58 would be arcuate and the side walls would generally correspond in shape to the side walls of the cavity 42, with such walls of the insert sleeve having impingement openings along a portion of the length thereof as described herein below. The back side of the sleeve or insert sleeve 58, disposed in opposition to the rib 72 separating cavity 42 from cavity 44, however, would not have impingement openings. Similarly, in the aft cavities 52, 54, the side walls of the insert sleeves 60 and 62 have impingement openings along a portion of the length thereof, as also described in more detail herein below, whereas the forward and aft walls of insert sleeves 60 and 62 are of a solid non-perforated material.

It will be appreciated that the insert sleeves received in cavities 42, 44, 46, 48, 50, 52, and 54 are spaced from the walls of the cavities to enable cooling media, e.g., steam, to flow through the impingement openings to impact against the interior wall surfaces of the cavities, hence cooling the wall surfaces.

The conventional insert sleeve design has impingement cooling holes defined along the entire length of the insert sleeve although the holes are generally confined to the sides of the insert sleeve facing exterior walls of the vane, as noted above. While heat transfer in the cavity in which such insert sleeves are disposed has been increased by the impingement generated by such insert sleeves, as noted above, there is a large pressure drop over the cavity which leads to more complicated designs elsewhere in the nozzle configuration. In addition, as the accumulated post impingement coolant progresses downstream from the upstream end of the cavity, the cross-flow degradation increases. This causes both low heat transfer coefficient and high uncertainty in calculating the coefficient.

The present invention was developed to decrease the pressure drop over the length of the cavity, allowing for more simplified designs elsewhere in the nozzle. The invention was further developed to decrease the uncertainty involved in estimating the heat transfer coefficients. The invention was also developed to increase the Low Cycle Fatigue (LCF) life along the cavity to meet design requirements.

The insert sleeve provided as an embodiment of the invention has impingement cooling holes located on an upstream part of the insert. The other, downstream part of the insert sleeve is substantially imperforate in that it does not contain impingement holes, but rather acts as a blocking mechanism to increase the heat transfer coefficient by reducing the coolant flow area in the cavity to the gap between the insert sleeve and the cavity interior wall. This design reduces unintended post impingement coolant cross-flow, allows for heat transfer coefficients to be more accurately estimated and allows for a reduction in pressure drop from the inlet of the cavity to the outlet.

Figure 3:
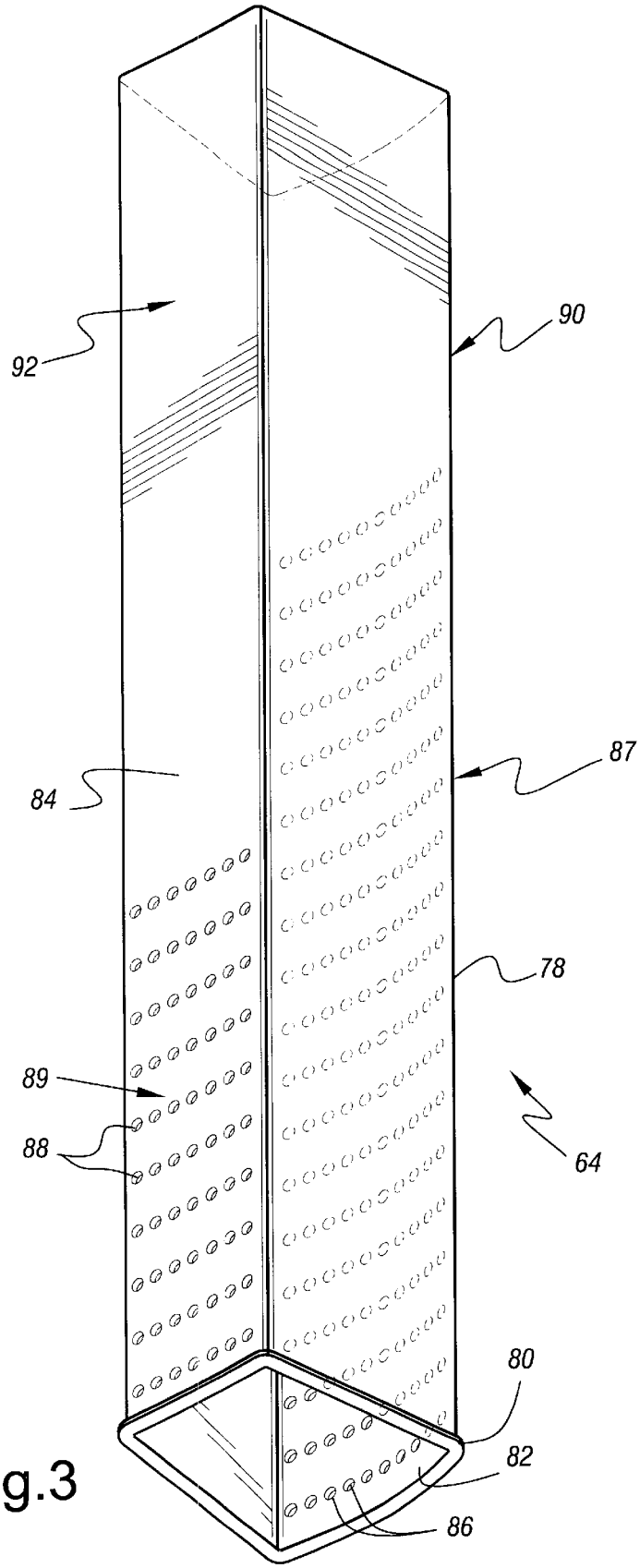
FIG. 3 is a perspective view of another insert sleeve embodying the invention.
Figure 4:
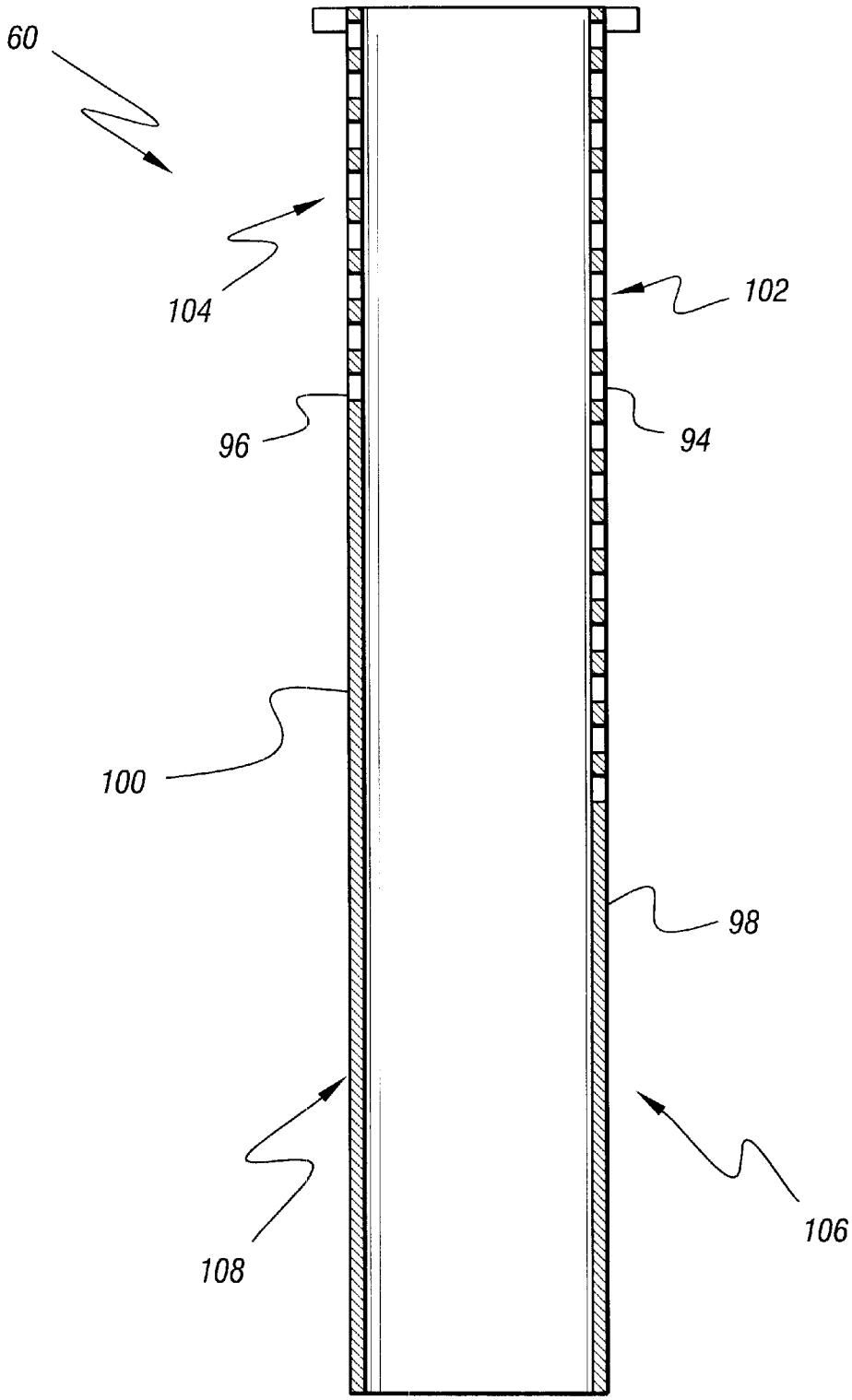
FIG. 4 is a schematic vertical cross-section of yet another insert sleeve embodying the invention.

The general form of exemplary insert sleeves embodying the invention is illustrated in FIGS. 2–4. FIG. 2 illustrates an exemplary insert sleeve for the leading edge cavity, whereas FIG. 3 illustrates an exemplary insert sleeve for one of the return cavities and FIG. 4 illustrates an exemplary impingement hole distribution for an aft cavity.

The insert sleeve illustrated in FIGS. 2–3, for example, insert sleeve 64, comprises an elongated sleeve 78 having an open lower or radially inner end with a marginal flange 80 for connection with a marginal flange (not shown) about the opening to the corresponding cavity, e.g., cavity 44. The side walls 82, 84 of the sleeve 78 are provided with a plurality of impingement cooling openings 86, 88, respectively. As illustrated, impingement cooling holes or openings 86, 88 are defined along first, upstream portions 87, 89 of this sleeve for flowing the cooling medium into the spaces between the sleeve and the interior vane wall surfaces to be impingement cooled. Second, downstream portions 90, 92 of the sleeve 78 do not have impingement holes. Instead, the downstream portions reduce the coolant flow area in the cavity 42 by defining channels that receive post impingement cooling flow from the spaces defined adjacent the first, impingement hole portions of the sleeve, thereby to increase the heat transfer coefficient. This design reduces the undesirable post impingement coolant (air or steam) cross-flow, allows for the heat transfer coefficient to be more accurately estimated, and allows for a reduction in pressure drop from the inlet of the cavity to the outlet.

As is further shown in FIG. 3, the extent of the portions of the sleeve on which the impingement holes 86, 88 are respectively provided is further dependent, in the presently preferred embodiment of the invention, upon whether the insert sleeve side wall faces the pressure side or suction side of the airfoil. While the extent of the impingement holes on each side can be varied as deemed necessary or desirable to achieve the objectives of the invention, it can be seen that the extent of the impingement is preferably greater on the pressure side 82 of the sleeve 78 than on the suction side 84.

Referring to FIG. 4, a similar type of insert sleeve 60 is provided in vane cavity 52. As illustrated, e.g. in FIG. 2, the peripheral outline of insert sleeve 60 follows the contour of the shape of cavity 52. The insert sleeve has impingement openings or holes 94, 96 on the side walls 98, 100 thereof whereby the coolant, whether it be steam or air, directed into the insert sleeve 60 from the plenum 32 (FIG. 1) flows outwardly through the impingement openings 94, 96 for impingement cooling of the outer walls of the vane on opposite sides of the cavity 52.

The extent of the portion of the insert sleeve 60 on which the impingement holes 94, 96 are respectively provided is further dependent, in the presently preferred embodiment of the invention, upon whether the insert sleeve side wall faces the pressure side or suction side of the airfoil. In that regard, while the extent of the impingement holes on each side can be varied as deemed necessary or desirable to achieve the objectives of the invention, it can be seen that the extent of the impingement holes is preferably greater on the pressure side 98 of the insert sleeve 60 than on the suction side 100.

The impingement cooling holes or openings 94, 96 are again located in upstream portions 102, 104 of the insert sleeve whereas the other, downstream portions 106, 108 of the insert sleeve 60 do not have impingement holes. Instead, the downstream portions reduce the coolant flow area in the cavity 52, thereby to increase the heat transfer coefficient. As with the insert sleeve in the leading edge cavity, and the return cavities, the design of this insert sleeve reduces the undesirable post impingement coolant cross-flow, allows for the heat transfer coefficient to be more accurately estimated, and allows for a reduction in pressure drop from the inlet of the cavity to the outlet.

Flow analysis software was used to determine the heat transfer coefficients, and pressure drop along both the impingement and convectively cooled regions of the cavity. The analysis showed a decrease in pressure drop along with an increase in the heat transfer coefficient with the above described design. For example, for the sixth cavity 52 of the stage one nozzle of an exemplary turbine system having a vane 10 with a length of about 6.32 inches, impingement holes 94 extending along about 5.05 inches (80%) and impingement holes 96 extending along about 2.88 inches (45%) was determined to provide adequate heat transfer coefficients on both pressure and suction sides and a minimum pressure drop across the cavity.

As illustrated in FIG. 1, the post-impingement cooling steam flows into a plenum 73 defined by the inner wall 14 and a lower cover plate 76. Structural strengthening ribs 75 are integrally cast with the inner wall 14. Radially inwardly of the ribs 75 is an impingement plate 74. As a consequence, it will be appreciated that the spent impingement cooling steam flowing from cavities 42, 52, and 54 flows into the plenum 73 for flow through the impingement openings of impingement plate 74 for impingement cooling of the inner wall 14. The spent cooling steam flows by direction of the ribs 75 towards the openings (not shown in detail) for return flow through the cavities 44, 46, 48, and 50, respectively, to the steam outlet 24. Insert sleeves 64, 66, 68, and 70 are disposed in the cavities 44, 46, 48, and 50 in spaced relation from the side walls and ribs defining the respective cavities. The impingement openings lie on opposite sides of the sleeves for flowing the cooling media, e.g., steam, from within the insert sleeves through the impingement openings for impingement cooling of the side walls of the vane, as generally discussed above. The spent cooling steam then flows from the gaps between the insert sleeves and the walls of the intermediate cavities to outlet 24 for return to the coolant, e.g., steam, supply.

The air cooling circuit of the trailing edge cavity 56 of the combined steam and air cooling circuit of the vane illustrated in FIG. 1 generally corresponds to that of the '766 patent and, therefore, a detailed discussion herein is omitted.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine vane segment, comprising:

inner and outer walls spaced from one another;

a vane extending between said inner and outer walls and having leading and trailing edges, said vane including a plurality of discrete cavities between the leading and trailing edges and extending lengthwise of said vane for flowing a cooling medium in a coolant flow direction lengthwise of said vane; and an insert sleeve within one said cavity and spaced from interior wall surfaces thereof, said insert sleeve having an inlet for flowing the cooling medium into said insert sleeve, a first wall of said insert sleeve consisting of a first portion and a second portion, said first portion extending from a first longitudinal end of said insert sleeve and having a plurality of holes therethrough for flowing the cooling medium through said sleeve holes into a gap defined between said first portion of said insert sleeve and first interior wall surfaces of said cavity facing thereto for impingement against said first interior wall surfaces, said second portion being downstream in said coolant flow direction from said first portion, and being substantially imperforate so as to define a convection cooling portion, said second portion of said insert sleeve and second interior wall surfaces of said cavity facing thereto defining a channel therebetween that is in flow communication with said gap for receiving from said gap the cooling medium flowing into said gap through said impingement holes.

2. A turbine vane segment as in claim 1, wherein a plenum is defined in said outer wall and said vane has at least a first opening in communication with said plenum to enable passage of cooling medium between said outer wall plenum and at least one of said cavities.

3. A turbine vane segment as in claim 1, wherein impingement holes are defined in first and second walls of the insert sleeve that face, respectively, pressure and suction sides of the vane, the impingement holes of at least one of said first and second walls being defined along substantially only a first, upstream portion thereof with respect to said coolant flow direction.

4. A turbine vane segment as in claim 3, wherein the impingement holes in the second wall, facing the suction side of the vane, extend along a lesser extent of the second wall than the impingement holes in the first wall.

5. A turbine vane segment as in claim 3, wherein said insert is disposed in an aft cavity of said vane.

6. A turbine vane segment as in claim 5, wherein said impingement holes in the first wall, facing the pressure side of the vane extend along about 80% of the length of the vane.

7. A turbine vane segment as in claim 5, wherein said impingement holes in the second wall, facing the suction side of the vane extend along about 45% of the length of the vane.

8. A turbine vane segment as in claim 1, wherein said insert is disposed in a leading edge cavity of said vane.

9. A turbine vane segment, comprising:

inner and outer walls spaced from one another;

a vane extending between said inner and outer walls and having leading and trailing edges and pressure and suction sides, said vane including discrete leading edge, intermediate, aft and trailing edge cavities between the leading and trailing edges and extending lengthwise of said vane for flowing a cooling medium in a coolant flow direction lengthwise of said vane; and an insert sleeve within at least one of said cavities and spaced from interior wall surfaces thereof, said insert sleeve having an inlet for flowing the cooling medium into said insert sleeve, impingement holes being defined in first and second walls of the insert sleeve facing respectively the pressure and suction sides of the vane, the impingement holes of at least one of said first and second walls being defined along substantially only a first portion thereof, extending from a first longitudinal end of said insert sleeve that is upstream with respect to said coolant flow direction, whereby the cooling flow is predominantly impingement cooling along a first region corresponding to said first, upstream portion and the cooling flow is predominantly convective cooling along a second region corresponding to a second portion of said at least one wall of said insert sleeve that is downstream with respect to said coolant flow direction.

10. A turbine vane segment as in claim 9, wherein said second, downstream portion of said at least one wall of said insert sleeve defines a reduced dimension coolant channel with an interior wall of the vane for receiving spent impingement coolant from said first region, thereby to increase the heat transfer coefficient.

11. A turbine vane segment as in claim 9, wherein the impingement holes of both the first and second walls of the insert sleeve extend along substantially only respective first, upstream portions thereof so that there is a transition to convective cooling along both said first and second walls.

12. A turbine vane segment as in claim 11, wherein the impingement holes in the second wall, facing the suction side of the vane, extend along a lesser extent of the second wall than the impingement holes in the first wall.

13. A turbine vane segment as in claim 9, wherein said insert is disposed in an aft cavity of said vane.

14. A turbine vane segment as in claim 13, wherein said impingement holes in the first wall, facing the pressure side of the vane extend along about 80% of the length of the vane.

15. A turbine vane segment as in claim 9, wherein said insert is disposed in a leading edge cavity of said vane.

16. A turbine vane segment, comprising:

inner and outer walls spaced from one another;

a vane extending between said inner and outer walls and having leading and trailing edges and pressure and suction sides, said vane including discrete leading edge, intermediate, aft and trailing edge cavities between the leading and trailing edges and extending lengthwise of said vane for flowing a cooling medium; and an insert sleeve within at least one of said cavities and spaced from interior wall surfaces thereof, said insert sleeve having an inlet for flowing the cooling medium into said insert sleeve, impingement holes being defined in first and second walls of the insert sleeve facing respectively the pressure and suction sides of the vane, the impingement holes of at least one of those first and second walls are defined along substantially only a first, upstream portion thereof, whereby the cooling flow is predominantly impingement cooling along a first region corresponding to said first, upstream portion and the cooling flow is predominantly convective cooling along a second region corresponding to a second, downstream portion of said at least one wall of said insert sleeve, wherein said insert is disposed in an aft cavity of said vane, wherein said impingement holes in the second wall, facing the suction side of the vane extend along about 45% of the length of the vane.

17. A stator vane segment, comprising:

inner and outer walls spaced from one another;

a vane extending between said inner and outer walls and having leading and trailing edges, said vane including a plurality of discrete leading edge, intermediate, aft and trailing edge cavities extending lengthwise of said vane;

said inner and outer walls defining respective plenums, an impingement plate being disposed in each said plenum, an inlet into said outer wall for flowing steam into the outer wall plenum and through the impingement plate in said outer wall plenum for impingement steam cooling another surface of said outer wall;

a first insert sleeve in one of said cavities for receiving spent impingement steam from said outer wall and having impingement holes for directing the steam received from said outer wall against interior wall surfaces of said one cavity for impingement cooling of the vane about said one cavity;

said inner wall having an opening for receiving the spent impingement steam from said one cavity into the inner wall plenum for flow through the impingement plate therein and impingement cooling of the inner wall;

a second insert sleeve in another of said cavities for receiving spent impingement steam from said inner wall and having impingement holes for directing the steam received from said inner wall against interior wall surfaces of said another cavity for impingement cooling of the vane about said another cavity; and an outlet for receiving the spent impingement steam from said another cavity, whereby the steam flow through said inner and outer walls, said one cavity and said another cavity constitutes a closed circuit through said vane, wherein the impingement holes of at least one of said first and second insert sleeves are defined solely along a first, upstream portion thereof that extends from a first longitudinal end of said insert sleeve, and a second portion thereof, downstream from said first portion with respect to a coolant flow direction lengthwise of said vane, is substantially imperforate so as to define a convection cooling portion, said second portion of said insert sleeve and interior wall surfaces of said vane facing thereto defining a channel therebetween for receiving the cooling medium that flows through the impingement holes of said first portion.

18. A turbine vane segment as in claim 17, wherein said impingement holes are defined in first and second walls of said insert sleeves that face, respectively, pressure and suction sides of the vane and wherein, the impingement holes in the second wall of said at least one of said first and second insert sleeves extend along a lesser extent of the second wall than the impingement holes in the first wall thereof.

19. A turbine vane segment as in claim 17, further comprising a third insert sleeve in a third of said cavities for receiving spent impingement steam from said outer wall and having impingement holes for directing the steam received from said outer wall against interior wall surfaces of said third cavity for impingement cooling of the vane about said third cavity;

wherein the impingement holes of said third insert sleeve are defined along a first, upstream portion thereof, while a second portion thereof, downstream in a coolant flow direction lengthwise of said vane from said first portion of said third insert sleeve is substantially imperforate so as to define a convection cooling portion, said second portion of said third insert sleeve and interior wall surfaces of said vane facing thereto defining a channel therebetween for receiving the cooling medium that flows through the impingement holes of said first portion of said third insert sleeve, said inner wall having an opening for receiving the spent impingement steam from said third cavity into the inner wall plenum for flow through the impingement plate therein and impingement cooling of the inner wall.

20. A turbine vane segment, comprising:

inner and outer walls spaced from one another;

a vane extending between said inner and outer walls and having leading and trailing edges, said vane including a plurality of discrete cavities between the leading and trailing edges and extending lengthwise of said vane for flowing a cooling medium; and an insert sleeve within one said cavity and spaced from interior wall surfaces thereof, said insert sleeve having an inlet for flowing the cooling medium into said insert sleeve, a first portion of said insert sleeve having a plurality of holes therethrough for flowing the cooling medium through said sleeve holes into said space between said sleeve and first interior wall surfaces of said cavity facing thereto for impingement against said first interior wall surfaces, a second portion of said insert sleeve, downstream in a coolant flow direction from said first portion being substantially imperforate so as to define a convection cooling portion, said second portion of said insert sleeve and second interior wall surfaces of said cavity facing thereto defining a channel therebetween that is in flow communication with said space for receiving the cooling medium flowing into said space, wherein said impingement holes are defined in first and second walls of the insert sleeve that face, respectively, pressure and suction sides of the vane, the impingement holes of at least one of those first and second walls are defined along substantially only a first, upstream portion of said respective wall, wherein said insert is disposed in an aft cavity of said vane, wherein said impingement holes in the second wall, facing the suction side of the vane extend along about 45% of the length of the vane.

* * * * *